US011485465B1

(12) United States Patent
Maresh

(10) Patent No.: US 11,485,465 B1
(45) **Date of Patent: *Nov. 1, 2022**

(54) PROPULSION APPARATUS FOR WATERCRAFT

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 612 days.

This patent is subject to a terminal disclaimer.

(21) Appl. No.: 16/503,260

(22) Filed: Jul. 3, 2019

Related U.S. Application Data

(60) Provisional application No. 62/764,220, filed on Jul. 23, 2018, provisional application No. 62/763,847, filed on Jul. 3, 2018.

(51) Int. Cl.
*B63H 16/08* (2006.01)
*B63H 16/20* (2006.01)

(52) U.S. Cl.
CPC ..... *B63H 16/14* (2013.01); *B63H 2016/202* (2013.01)

(58) Field of Classification Search
CPC ..... B63H 16/12; B63H 16/14; B63H 16/18; B63H 16/20; B63H 2016/202
USPC ..... 440/21, 26, 27, 28, 29, 30, 31, 32
See application file for complete search history.

(56) References Cited

U.S. PATENT DOCUMENTS

| | | | | |
|---|---|---|---|---|
| 9,359,052 | B2 * | 6/2016 | Ketterman | B63H 1/32 |
| 9,475,559 | B2 * | 10/2016 | Czarnowski | B63B 32/64 |
| 9,669,913 | B1 * | 6/2017 | Maresh | B63H 5/00 |
| 11,192,620 | B1 * | 12/2021 | Maresh | B63B 34/26 |

* cited by examiner

*Primary Examiner* — Daniel V Venne
(74) *Attorney, Agent, or Firm* — Nick A Nichols, Jr

(57) ABSTRACT

A watercraft propulsion apparatus includes an eccentric crank assembly operatively connected to a pair of fins adapted to sweep back and forth in a generally transverse direction relative to a longitudinal axis of the watercraft. The fins may be rotatable about a first axis coplanar to the longitudinal axis of the watercraft. A drive linkage assembly operatively connecting the eccentric crank assembly to the pair of fins imparts a torque force to oscillate the pair of fins. The oscillating fins provide a propulsive force to propel the watercraft longitudinally forward during both oscillating directions of the fins as they sweep back and forth.

12 Claims, 9 Drawing Sheets

PROPULSION APPARATUS FOR WATERCRAFT

CROSS-REFERENCE TO RELATED APPLICATION

This application claims priority to and the benefit of the filing date of U.S. Provisional Application Ser. No. 62/763,847, filed Jul. 3, 2018, which application is herein incorporated by reference in its entirety.

BACKGROUND

The present invention relates to watercraft propulsion, particularly, oscillating fin propulsion.

Pedal operated propulsion apparatus, such as a foot operated paddle boat described in U.S. Pat. No. 3,095,850, are known in the art. Other pedal operated means linking rotatable pedals to a propeller have been proposed. Some have looked to the swimming motion of sea creatures to design mechanically powered propulsion systems. Generally speaking, the swimming behavior of sea creatures may be classified into two distinct modes of motion: middle fin motion or median and paired fin (MPF) mode and tail fin or body and caudal fin (BCF) mode, based upon the body structures involved in thrust production. Within each of these classifications, there are numerous swimming modes along a spectrum of behaviors from purely undulatory to entirely oscillatory modes. In undulatory swimming modes thrust is produced by wave-like movements of the propulsive structure (usually a fin or the whole body). Oscillatory modes, on the other hand, are characterized by thrust production from a swiveling of the propulsive structure at the attachment point without any wave-like motion. A penguin or a turtle, for example, may be considered to have movements generally consistent with an oscillatory mode of propulsion.

In 1997, Massachusetts Institute of Technology (MIT) researchers reported that a propulsion system that utilized two oscillating blades of MPF mode produced thrust by sweeping back and forth in opposite directions had achieved efficiencies of 87%, compared to 70% efficiencies for conventional watercraft. A 12-foot scale model of the MIT *Proteus* "penguin boat" was capable of moving as fast as conventional propeller driven watercraft. Another MIT propulsion system referred to as a "Robotuna," utilized a tail in BCF mode propulsion patterned after a blue fin tuna, achieved efficiencies of 85%. Based upon limited studies, higher efficiencies of 87% (and by some reports 90-95% efficiency) may be possible with oscillatory MPF mode propulsion that may enable relatively long distances of human powered propulsion being achieved both on and under the water surface.

SUMMARY

A watercraft propulsion apparatus includes an eccentric crank assembly operatively connected to a pair of fins adapted to sweep back and forth in a generally transverse direction relative to a longitudinal axis of the watercraft. The fins may be rotatable about a first axis coplanar to the longitudinal axis of the watercraft. A drive linkage assembly operatively connecting the eccentric crank assembly to the pair of fins imparts a torque force to oscillate the pair of fins. The oscillating fins provide a propulsive force to propel the watercraft longitudinally forward during both oscillating directions of the fins as they sweep back and forth.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
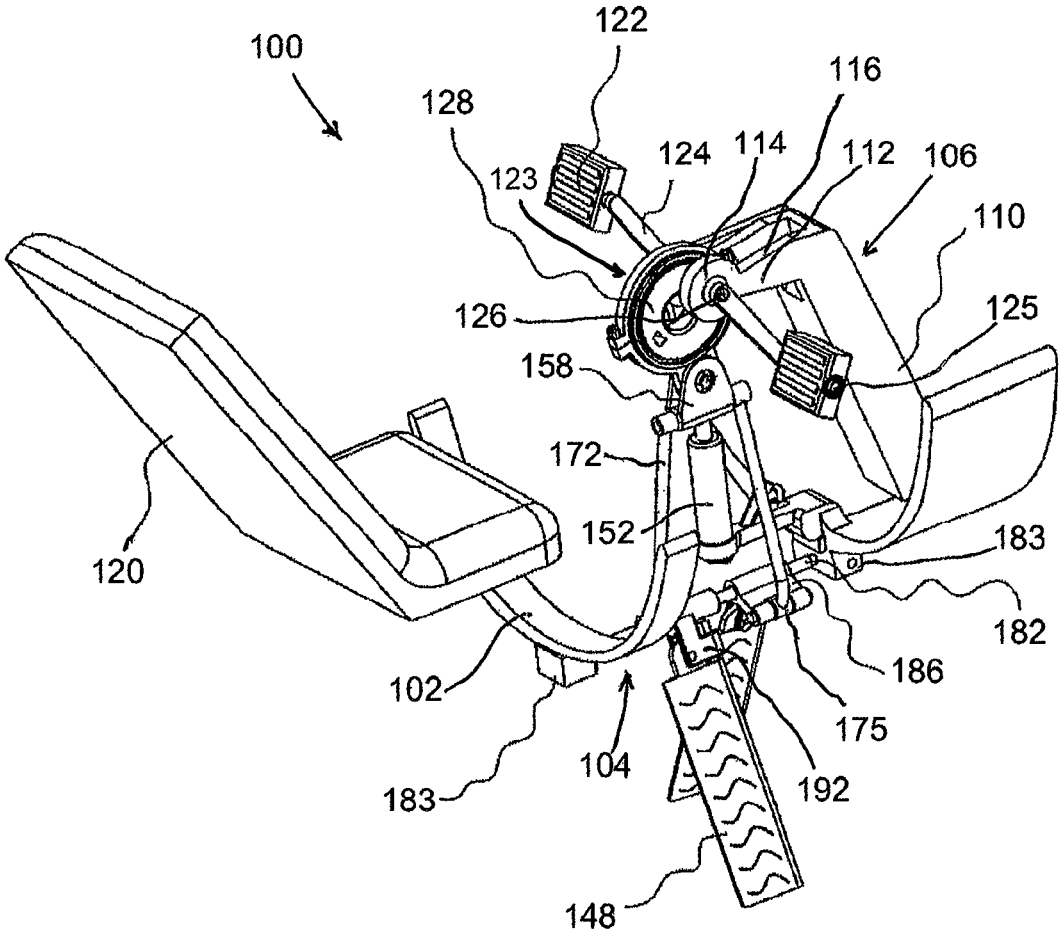
FIG. 1 is a cut away perspective view of a watercraft equipped with a propulsion apparatus.

Referring first to FIG. 1, a watercraft propulsion apparatus is generally identified by the reference numeral 100. A watercraft, for example but without limitation, a kayak, canoe, paddle board and the like, may be propelled by the propulsion apparatus 100. The watercraft may include a hull 102 and a passageway or opening 104 through the bottom of the hull 102. The propulsion apparatus 100 may be fixedly secured a bottom surface within the hull 102. A pair of flexible fins may extend through the opening 104 below the water surface. The interface of the propulsion apparatus 100 with the watercraft hull 102 may be sealed in a known manner to prevent entry of water into the watercraft hull 102.

The propulsion apparatus 100 may include a frame 106, including a base 108 and a stanchion 110 extending generally vertically upward from the base 108. A pair of arm members 112 spaced apart from one another may extend generally horizontally from proximate the upper distal end of the stanchion 110. The arm members 112 may terminate in lobes 114 and define a gap 116 therebetween. The lobes 114 may include holes 118 which are axially aligned relative to one another.

A user may sit on seat 120 and operate the propulsion apparatus 100 upon engaging the foot pedals 122 of a crank assembly 123 and moving the foot pedals 122 through a cycling motion. The foot pedals 122 may be rotatably secured about bearing shafts 125 which are fixedly secured to crank arms 124. The crank arms 124 may be connected to crank shafts 126. The crank shafts 126 are fixedly secured to opposite sides of an eccentric crank disc 128 offset from the center of the eccentric crank disc 128. The crank shafts 126 extend through the aligned holes 118 of the arm members 112 and rotatably support the eccentric crank disc 128 between the arm members 112 in the gap 116. Bearings 127 may be included between the crank shafts 126 and the aligned holes 118. The foot pedals 122 are rotatable about a common axis defined by the crank shafts 126.

Figure 2:
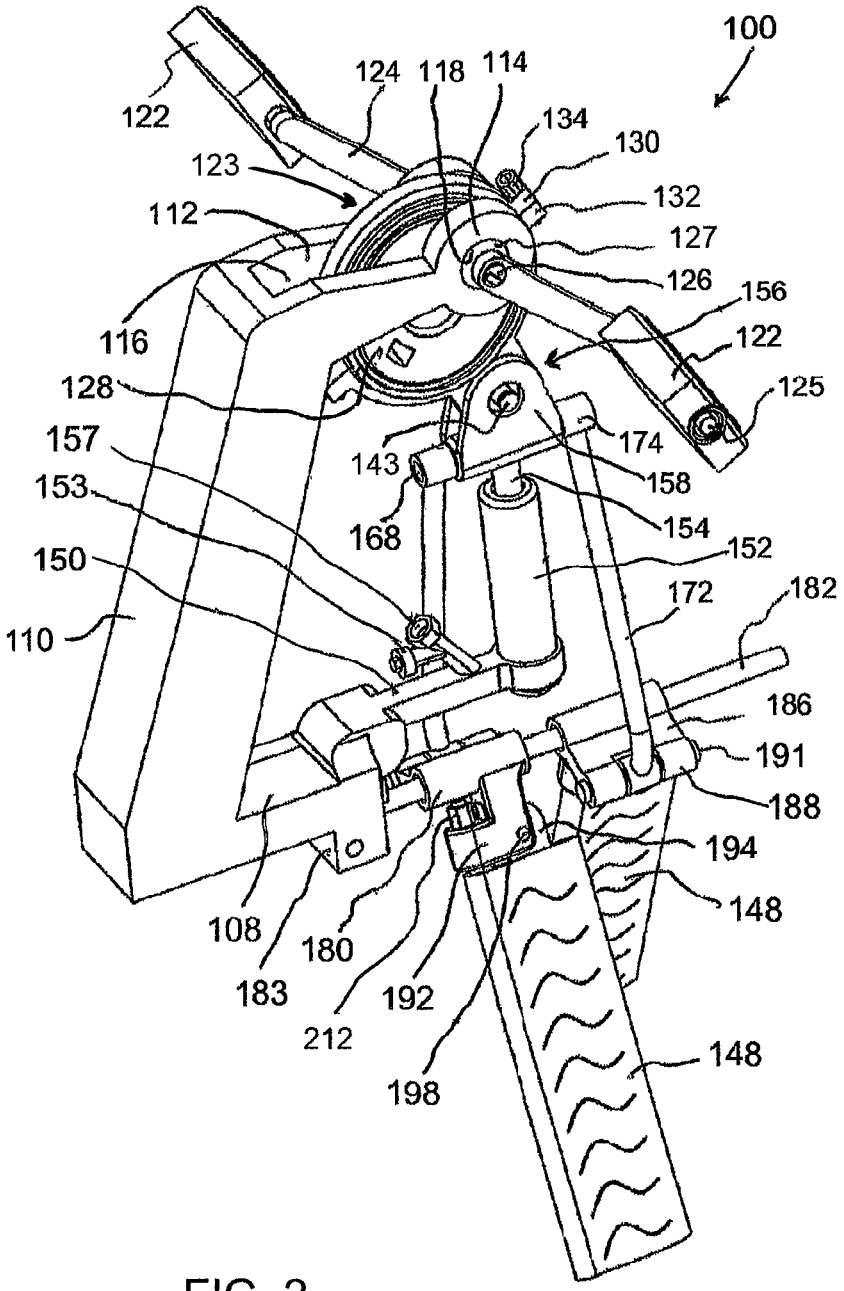
FIG. 2 is a perspective view of the propulsion apparatus shown in FIG. 1.
Figure 3:
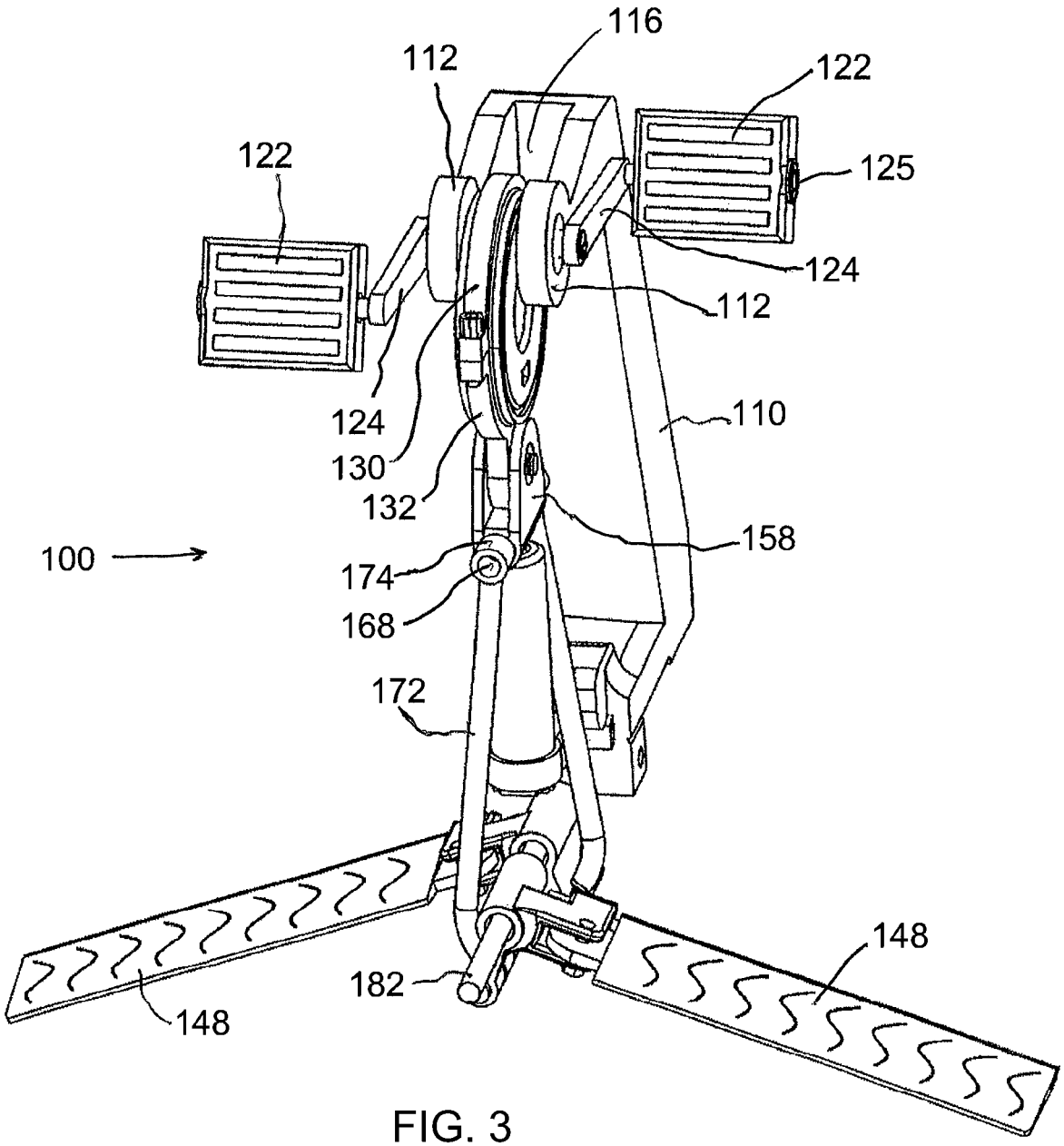
FIG. 3 is a front perspective view of the propulsion apparatus shown in FIG. 1.
Figure 4:
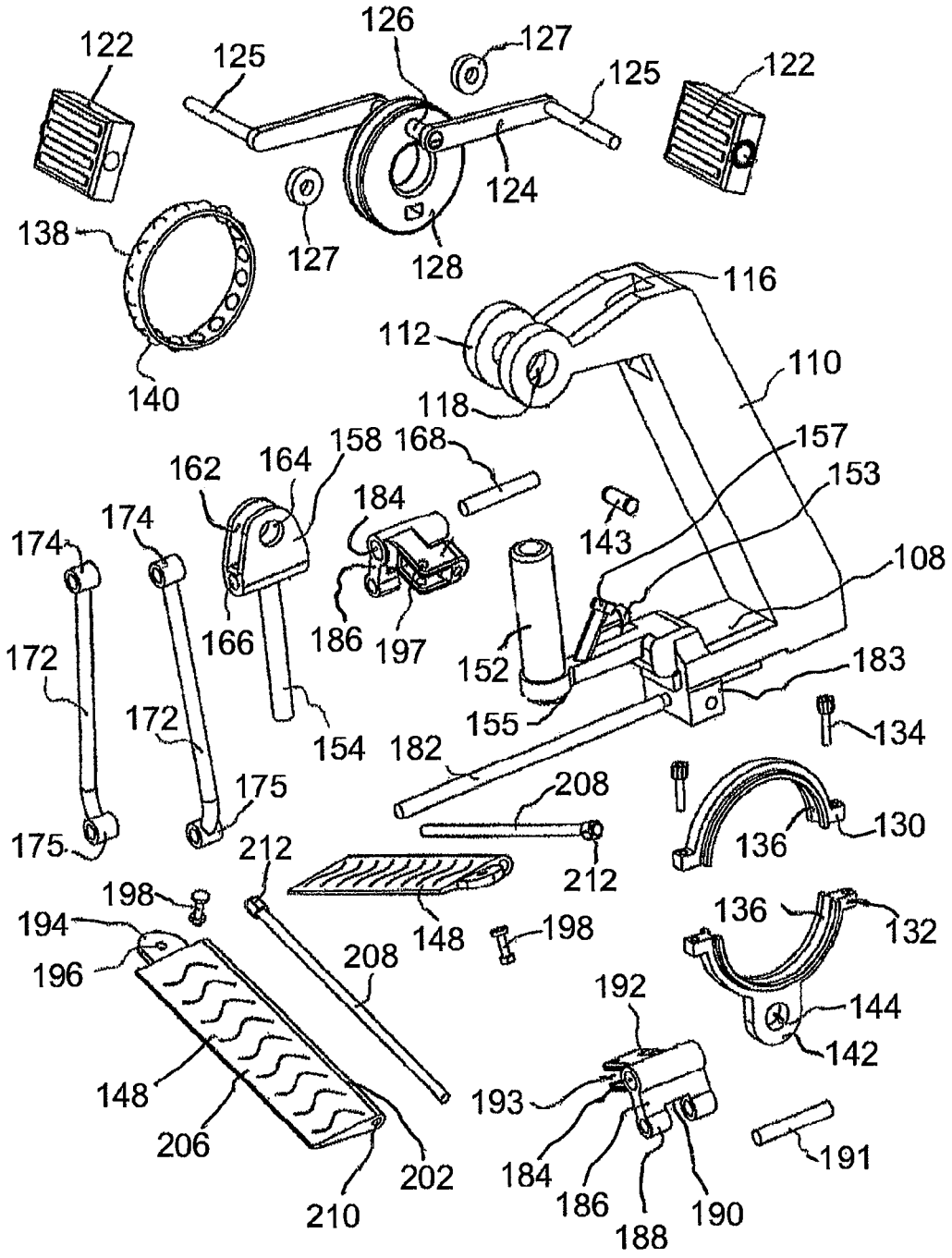
FIG. 4 is an exploded view of the propulsion apparatus shown in FIG. 1.
Figure 5A:
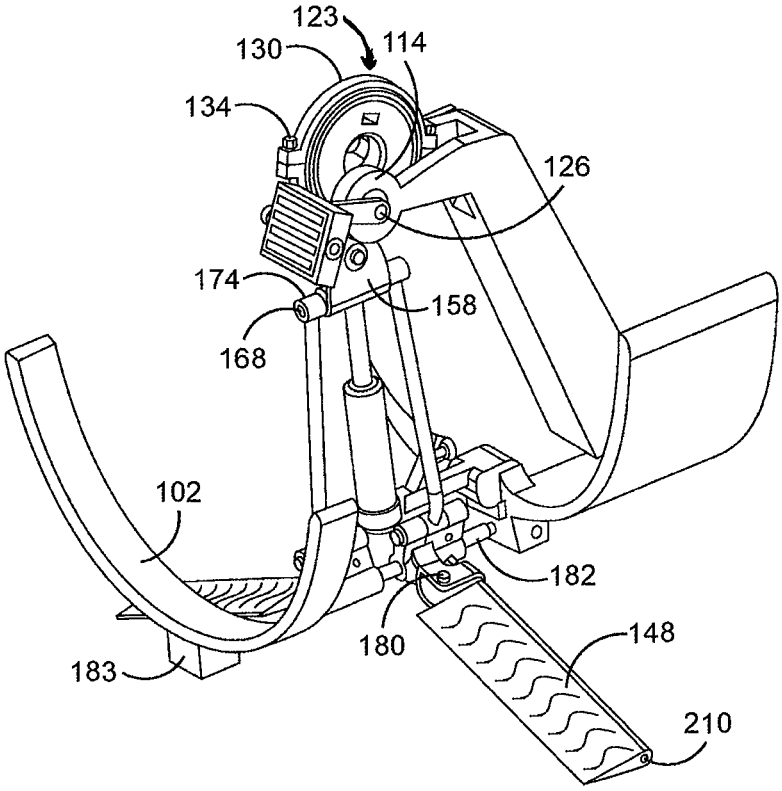
FIG. 5A is a perspective view of the propulsion apparatus shown in FIG. 1 illustrating a first foot pedal position.
Figure 5B:
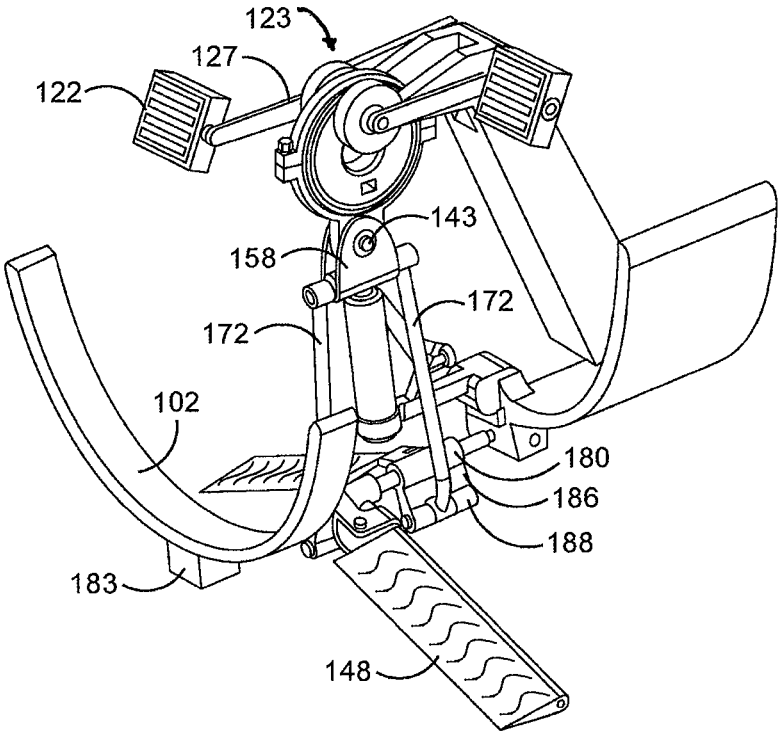
FIG. 5B is a perspective view of the propulsion apparatus shown in FIG. 1 illustrating a second foot pedal position.
Figure 6:
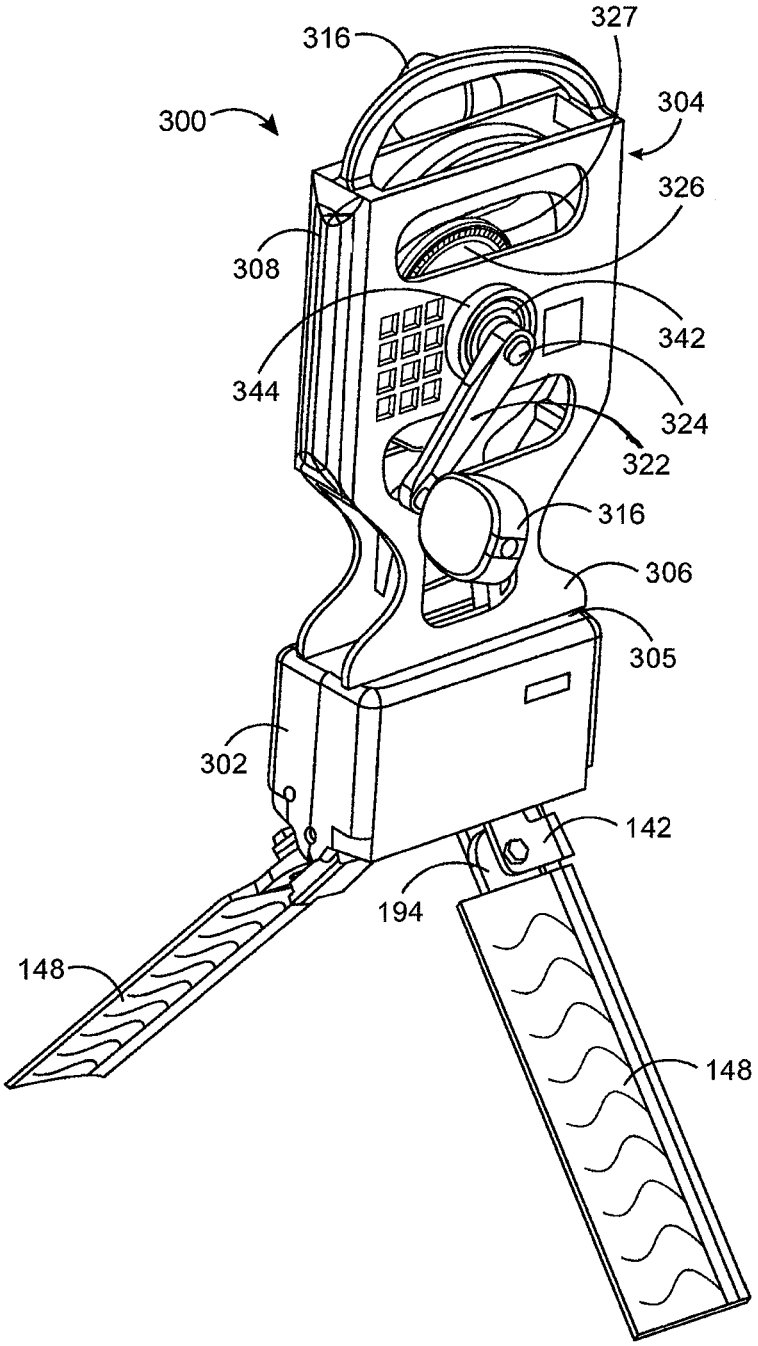
FIG. 6 is a perspective of a second embodiment of a watercraft propulsion apparatus.
Figure 7:
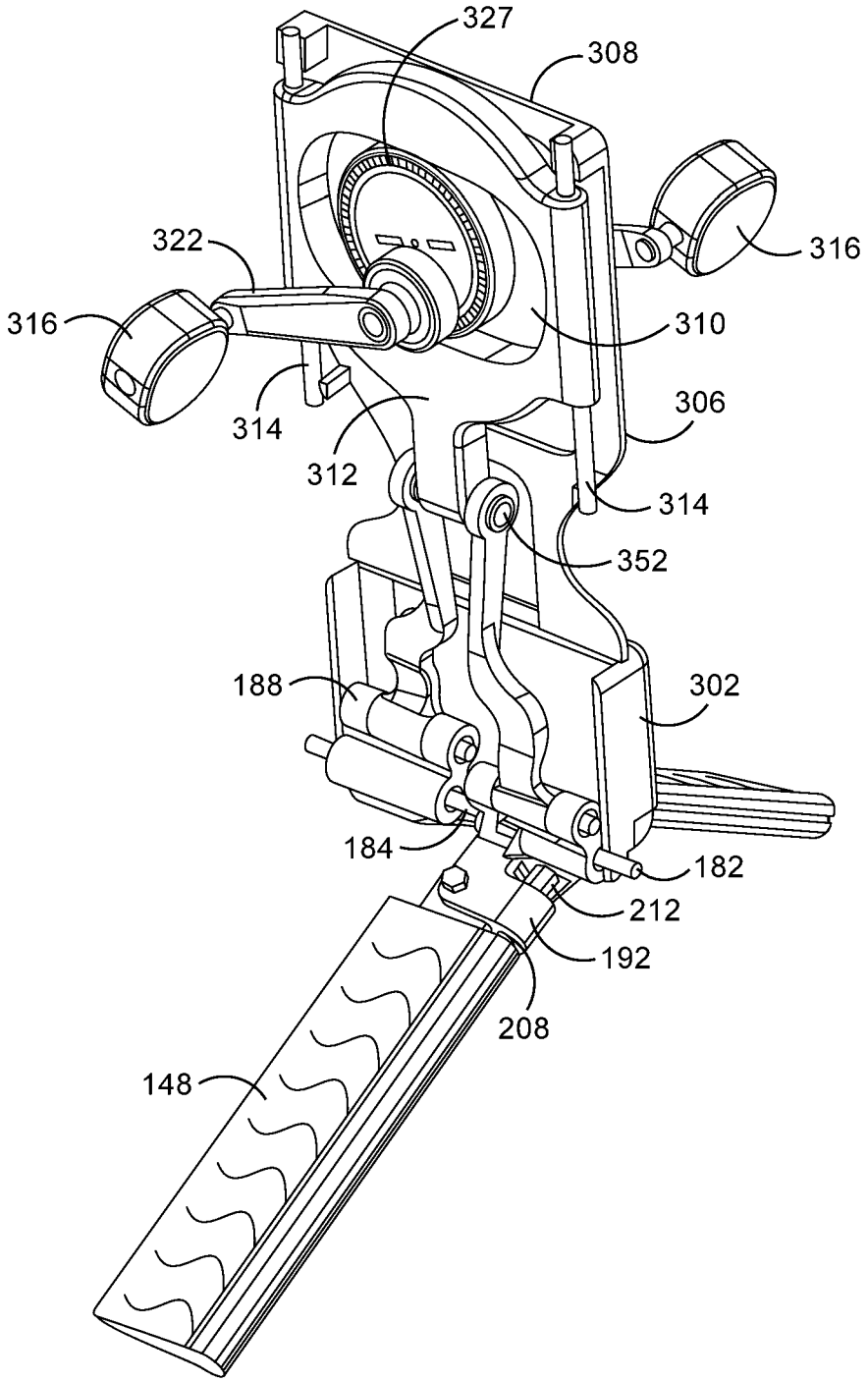
FIG. 7 is a perspective of the propulsion apparatus shown in FIG. 6 with a front portion removed.
Figure 8:
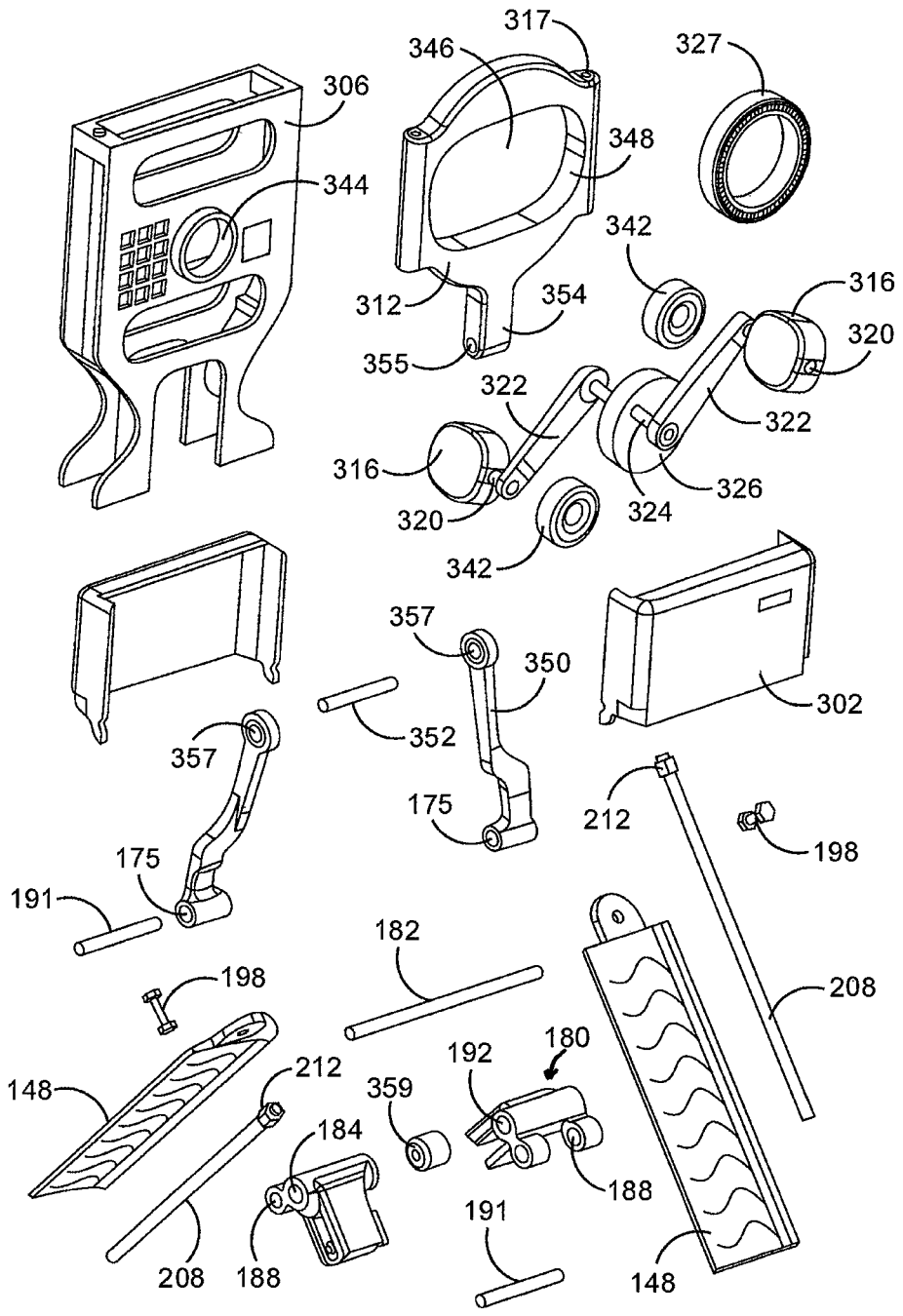
FIG. 8 is an exploded view of the propulsion apparatus shown in FIG. 6.
Figure 9A:
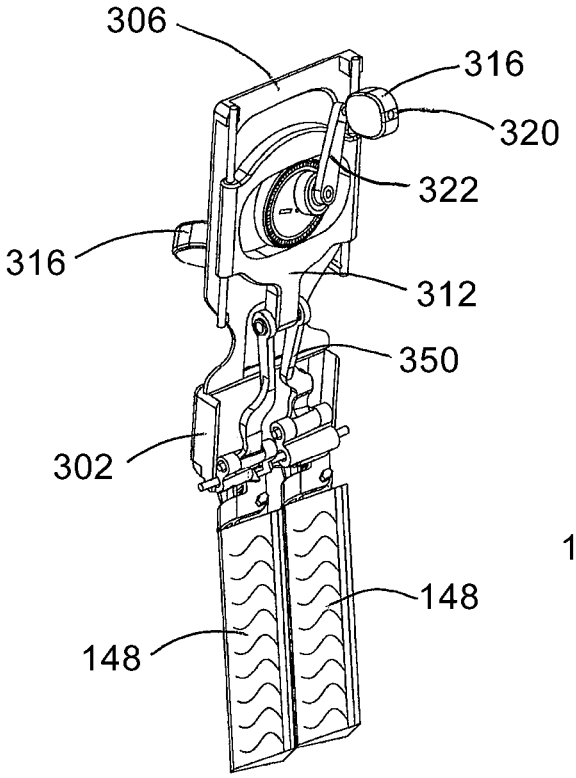
FIGS. 9A-9D are perspective views of the propulsion apparatus shown in FIG. 6 illustrating the position of the fins at various foot pedal positions.
Figure 9B:
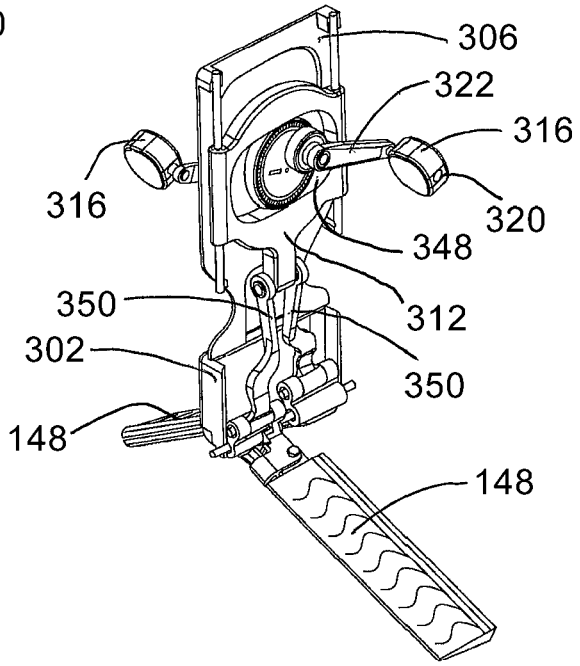
Figure 9C:
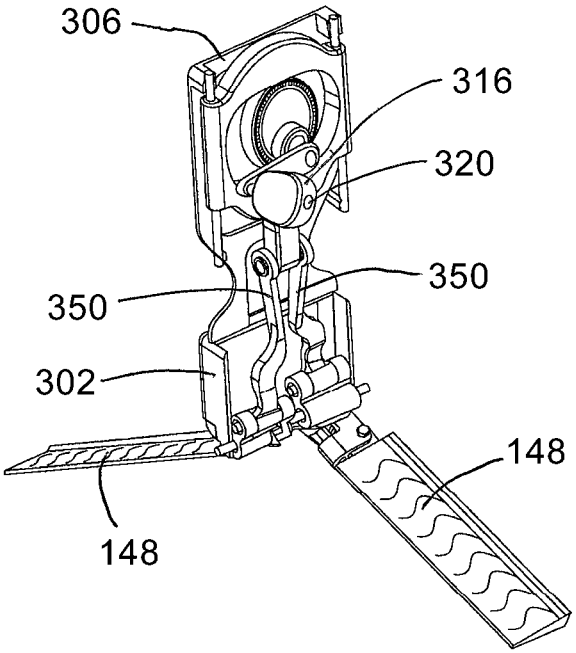
Figure 9D:
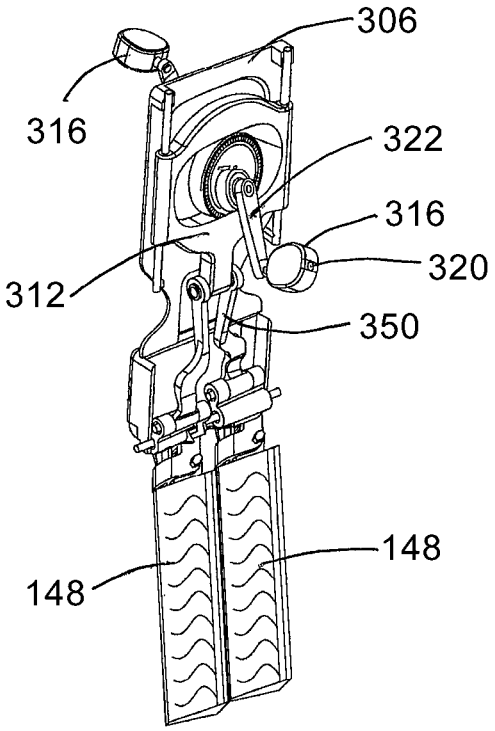

Referring now to FIG. 2, a split collar 129 may be mounted about the eccentric crank disc 128. The split collar 129 comprise an upper collar member 130 and a lower collar member 132. The collar members 130, 132 may be joined together by connectors 134, such as but without limitation, a bolt and the like. The lower collar member 132 may include a downwardly extending boss 142 having a through hole 144, best shown in FIG. 4.

The collar members 130, 132 may include inner grooves 136 that align upon joining the collar members 130, 132 to form an inner circumferential concave race for receipt of a flexible cage strip bearing 138. The strip bearing 138 may support a series of bearing balls 140 to reduce rotational friction and support radial and axial loads upon rotation of the eccentric crank disc 128 within the split collar 129. Alternatively, other bearing configurations known in the art may be utilized.

A drive linkage assembly may operatively connect the crank assembly 123 to fins 148. The drive assembly may include a support beam 150 fixedly connected to the frame base 108. The support beam 150 may extend generally horizontally outward in collinear relationship with the frame base 108. A tubular member 152, open at a top end and closed at a bottom end thereof, may be fixedly secured at the distal end of the support beam 150. The tubular member 152 may extend generally vertically upward from the support beam 150. The tubular member 152 may optionally include an inlet port check valve 153 in fluid communication with an outlet port flapper check valve 155 to form a bilge pump to remove any excess water that may accumulate in the watercraft. The excess water may be removed from the watercraft through a drain hose connected to a discharge port 157. A o-ring may be fitted about a bar 154 (described in greater detail hereinafter) to form a seal between the bar 154 and the inner surface of the tubular member 152.

The drive linkage assembly may further include an elongated bar 154 sized for reciprocal movement in the tubular member 152. The bar 154 in the drawings is depicted as being cylindrical in shape but it is understood that the bar 154 may include other shapes suitable for the intended function of the bar 154. A connector 156 may be fixed to the upper distal end of the elongated bar 154. The connector 156 may include two sidewalls 158 projecting upwardly from a bottom wall 160. The sidewalls 158 are spaced apart from one another and define a slot 162 therebetween. The sidewalls 158 may include through holes 164 axially aligned with one another. The boss 142 extending from the lower split crank 132 may be received in the slot 162 and pivotally connected to the bar 154 at pivot pin 143. An open-ended horizontal bore 166 may extend through the bottom wall 160 of the connector 156. The bore 166 may be sized to receive a bearing shaft 168. The length of the bearing shaft 168 may be greater than the length of the horizontal bore 166 so that the opposite distal ends of the bearing shaft 168 project outwardly from each end of the bore 166.

Actuator rods 172 may be coupled to the bearing shaft 168 at the distal ends thereof. The actuator rods 172 may include an elongate body having upper ends 174 sized to slide over the distal ends of the bearing shaft 168 projecting from the bore 166. A lower end 175 of the actuator rods 172 may rotatably connect to journal blocks 180.

Referring again to FIG. 1, the propulsion apparatus 100 may include journal blocks 180 rotatably secured to a longitudinal shaft 182 which is fixedly secured to support members 183 fixed to bottom of the frame hull 102. The journal blocks 180 may include boreholes 184 for receiving the shaft 182 therethrough. The longitudinal axis of the boreholes 184 may be coincident with the longitudinal axis of the shaft 182. The journal blocks 180 may include a radially extending plate 186. A pair of spaced apart tubes 188 may be fixedly secured to a lateral edge of the plate 186. Alternatively, the tubes 188 may be integrally formed with the plate 186. The tubes 188 may be axially aligned on the edge of the plate 186 and define a gap 190 between them. The lower end 175 of the actuator rods 172 may be received in the gap 190 and pivotally connected to the journal blocks 180 by a pin 191.

Fin clews 192 fixed to the journal blocks 180 may secure the fins 148 to the journal blocks 180. The fin clews 192 may define a slot or cavity 193 for receiving a fin tab 194 projecting from the base of the fins 148. The fin tab 194 and the fin clews 192 may include through holes 196 and 197, respectively, which upon alignment may receive clew bolt 198 securing the fins 148 to the journal blocks 180.

The fins 148 may comprise a substantially flat body that is thicker along a generally rigid leading edge 202 and a generally flexible region 204. The thickness of the fins 148 may gradually decrease from the leading edge 202 to a trailing edge 206. The stiffness or rigidity of the fins 148 is generally greater at the leading edge 202 and decreases toward the trailing edge 206. Combinations of different materials in the manufacture of the fins 148 or other manufacturing means may alter the stiffness characteristics of the fins 148.

A mast 208 secured to the fin clews 192 may be received in an elongated borehole 210 in the leading edge 202 of the fins 148. A hex nut 212 or other suitable connector may secure the mast 208 to the fin clew 192. The fins 148 may re-orientate a limited amount, back and forth, while oscillating to create an optimum angle of attack against the water in a manner known in the art. The fin clews 192 limit the angle of attack of the oscillating fins 148, typically not more than plus or minus thirty degrees (+/−30°) of oscillation. Other clew means may be employed as known in the art. Alternatively, the upper region of the fins 148 may be rigidly secured to the journal blocks 180.

During operation of the propulsion apparatus 100, a user engages the foot pedals 122 and cycles the crank arms 124 to rotate the eccentric crank disc 128 and thereby move the bar 154 and rods 172 in a generally vertical reciprocal motion oscillate the fins 148.

Referring now to FIGS. 6-8 and 9A-9D, a second embodiment of a watercraft propulsion apparatus is generally identified by the reference numeral 300. As indicated by the use of common reference numerals, the propulsion apparatus 300 is similar to the propulsion apparatus 100 described hereinabove. The propulsion apparatus 300 may include a lower housing 302 which may be secured to the hull of a sit-on-top kayak and the like. An upper housing 304 may be fixedly secured to the top wall 305 of the lower housing 302. The upper housing 304 may include sidewalls 306 and end walls 308 defining an enclosure 310. A moving block 312 linearly constrained to move along guideposts 314 may be housed in the enclosure 310. Typically, guideposts 314 are fixed and may be polished metal received in longitudinal boreholes 317 of the moving block 312. The moving block 312 may be constructed of plastic, with or without metal or synthetic bushings or journals, or the employment of any style of linear bearings known in the art to constrain the moving block 312 relative to the guideposts 314. UHMW and the like may be appropriate material for the moving blocks 312. Alternatively, in an alternate embodiment the guideposts 314 may move relative to the moving block 312 which may be stationary.

A user may engage the foot pedals 316 of a crank assembly 318 and move the foot pedals 316 through a cycling motion. The foot pedals 316 may be rotatably secured about bearing shafts 320 which are fixedly secured to crank arms 322. The crank arms 322 may be connected to crank shafts 324 which are fixedly secured to opposite sides of an eccentric crank disc 326 at a point offset from the center of the eccentric crank disc 326. The foot pedals 316 are rotatable about a common axis defined by the crank shafts 324. The eccentric crank disc 326 may be provided with optional bearings 327 about the circumferential edge thereof.

The crank shafts 324 may extend through openings 340 in the upper housing sidewalls 306 and support the eccentric crank disc 326 within the enclosure 310. The crank shafts 324 may be supported by crank bearings 342 received in bearing housings 344 which are secured in the openings 340 of the housing sidewalls 306.

The moving block 312 may include an opening 346 circumscribed by a race 348. The drum 326 may be received in the opening 346. Cycling movement of the foot pedals 316 rotates the eccentric crank disc 326 which exerts a force against the race 348 causing reciprocal movement of the moving block 312 on the guideposts 314. Typically a fit-to-fit assembly of the moving block 312 and eccentric crank disc 326 may be adequate to minimize noise of cyclic impact between bearing 327 and the race 348 because thrust is only exerted at an upper or lower point of the race 348 at any given instant but does not occur at both upper and lower points of the race 348 simultaneously. Noise may further be reduced with a nonmetallic moving block 312 and/or use of optional needle bearings. A pair of actuator links 350 may be pivotally connected to a post 354 extending downward from the moving block 312 at a pivot pin 352 extending through a borehole 355 in the post 354 and through holes 357 in the upper distal ends of the actuator links 350. The actuator links 350 may be pivotally secured to the fin journal blocks 180 by pins 191. The spacing between journal blocks 180 may be maintained by a spacer 359 rotatably mounted on the longitudinal shaft 182 between the journal blocks 180.

During cycling, reciprocal movement of the moving block 312 causes the actuator links 350 to oscillate the fins 148. The fin configuration and geometry shown in FIGS. 9A-9D illustrates oscillating movement of the fins 148 through a range of about one hundred thirty-two degrees (132°) in sinusoidal motion.

While a preferred embodiment of the invention has been shown and described, other and further embodiments of the invention may be devised without departing from the basic scope thereof, and the scope thereof is determined by the claims which follow.

The invention claimed is:

1. A watercraft propulsion apparatus, comprising:

a) a frame fixedly secured to a hull of a watercraft, said frame including a base and a stanchion extending generally vertically from said base;

b) a pair of arm members spaced apart from one another extending generally horizontally from proximate an upper distal of said stanchion;

c) an eccentric crank disc rotatably supported by said pair of arm members;

d) a drive linkage assembly interconnecting said eccentric crank disc to a pair of fins extending downwardly from said frame; and e) wherein rotational movement of said eccentric crank disc imparts a force to oscillate said pair of fins transversely to a center longitudinal axis of the watercraft.

2. The watercraft propulsion apparatus of claim 1 including a left foot support and a right foot support operatively connected to said eccentric crank disc.

3. The watercraft propulsion apparatus of claim 1 including a split collar mounted about a circumferential edge of said eccentric crank disc, said split collar including inner grooves defining a concave circumferential race adapted for receipt of a strip bearing disposed between said split collar and said circumferential edge of said eccentric crank disc.

4. The watercraft propulsion apparatus of claim 3 wherein said split collar includes an upper collar member and a lower collar member, said lower collar member including a downwardly projecting boss member.

5. The watercraft propulsion apparatus of claim 4 wherein said drive linkage assembly includes a support beam fixedly connected to said frame, a tubular member secured to said beam extending generally vertically upward, an elongated bar reciprocally received in said tubular member and pivotally connected to said boss member.

6. The watercraft propulsion apparatus of claim 1 wherein said drive linkage assembly includes a pair of actuator rods operatively connecting said eccentric crank disc to a respective pair of journal blocks, said pair of fins fixedly connected to said pair of journal blocks.

7. The watercraft propulsion apparatus of claim 1 wherein said pair of fins are rotatably secured to a longitudinal shaft secured to the watercraft.

8. A watercraft propulsion apparatus, comprising:

a) a crank assembly;

b) a drive linkage assembly;

c) A pair of fins operable to provide a propulsive force to move a watercraft longitudinally forward;

d) wherein said crank assembly includes a rotatable eccentric crank disc operatively connected to said pair of fins.

9. The watercraft propulsion apparatus of claim 8 including a left foot support and a right foot support operatively connected to said eccentric crank disc.

10. The watercraft propulsion apparatus of claim 9 wherein said linkage assembly includes a moving block linearly constrained to reciprocally move upon rotational movement of said eccentric crank disc.

11. The watercraft propulsion apparatus of claim 10 wherein said moving block includes an opening configured to receive said eccentric crank disc.

12. The watercraft propulsion apparatus of claim 10 including a pair of actuator links operatively connecting said moving block to a respective pair of journal blocks, said pair of fins fixedly connected to said pair of journal blocks.

* * * * *